US009126724B2

(12) United States Patent
VanLoocke

(10) Patent No.: US 9,126,724 B2
(45) Date of Patent: Sep. 8, 2015

(54) CHILD-RESISTANT ZIPPER ASSEMBLIES AND PACKAGES UTILIZING THE SAME

(71) Applicant: Exopack, LLC, Spartanburg, SC (US)

(72) Inventor: Cory Klaiber VanLoocke, Charlotte, NC (US)

(73) Assignee: Exopack LLC, Spartanburg, SC (US)

( * ) Notice: Subject to any disclaimer, the term of this patent is extended or adjusted under 35 U.S.C. 154(b) by 257 days.

(21) Appl. No.: 13/833,383

(22) Filed: Mar. 15, 2013

(65) Prior Publication Data

US 2014/0259559 A1 Sep. 18, 2014

(51) Int. Cl.

| | |
|---|---|
| ***A44B 19/30*** | (2006.01) |
| ***B65D 33/25*** | (2006.01) |
| *A44B 19/16* | (2006.01) |

(52) U.S. Cl.

CPC ..... *B65D 33/2591* (2013.01); *A44B 19/16* (2013.01); *B65D 2215/02* (2013.01); *Y10T 24/2532* (2013.01)

(58) Field of Classification Search

CPC .. B65D 33/2591; B65D 33/25; B65D 33/188; B65D 33/2508; B65D 2215/00

USPC ..... 383/64; 24/399, 400, 437

See application file for complete search history.

(56) References Cited

U.S. PATENT DOCUMENTS

| | | | | |
|---|---|---|---|---|
| 3,426,396 | A * | 2/1969 | Laguerre | 24/427 |
| 3,855,669 | A | 12/1974 | Meyer | |
| 5,681,115 | A | 10/1997 | Diederich et al. | |
| 6,490,769 | B2 * | 12/2002 | Siegel | 24/415 |
| 7,506,416 | B2 * | 3/2009 | Hoffman et al. | 24/417 |
| 2003/0014848 | A1 | 1/2003 | Larue et al. | |
| 2006/0133700 | A1 | 6/2006 | Cappel | |
| 2009/0148080 | A1 | 6/2009 | Gzybowski | |

OTHER PUBLICATIONS

Notification of Transmittal of the International Search Report and the Written Opinion of the International Searching Authority mailed Jul. 1, 2014 in International Application No. PCT/US2014/021844, filed Mar. 7, 2014.

* cited by examiner

*Primary Examiner* — Jack W Lavinder
(74) *Attorney, Agent, or Firm* — Stoel Rives LLP

(57) ABSTRACT

The present disclosure relates to zipper assemblies and, in particular, child-resistant zipper assemblies. The zipper assemblies may be used with packaging material to make child-resistant packages.

19 Claims, 4 Drawing Sheets

CHILD-RESISTANT ZIPPER ASSEMBLIES AND PACKAGES UTILIZING THE SAME

TECHNICAL FIELD

The present disclosure relates to zipper assemblies and, in particular, child-resistant zipper assemblies. The zipper assemblies may be used in the packaging industry.

BRIEF DESCRIPTION OF THE DRAWINGS

The written disclosure herein describes illustrative embodiments that are non-limiting and non-exhaustive. Reference is made to certain of such illustrative embodiments that are depicted in the figures, in which.

DETAILED DESCRIPTION

Zippers provide a convenient way of opening and resealing a package. When the contents of a package may be harmful to children, such as laundry or dishwashing detergent, the convenience of zippers may pose a risk of harm to children. Slider zippers make it even easier to open and reseal a zipped package. For potentially harmful contents, the increased convenience of slider zippers may then translate into increased risk of harm to children. Embodiments disclosed herein can provide slider zipper assemblies and packages utilizing them that may have decreased risk of harm to children, as compared with conventional zippers.

Figure 1:
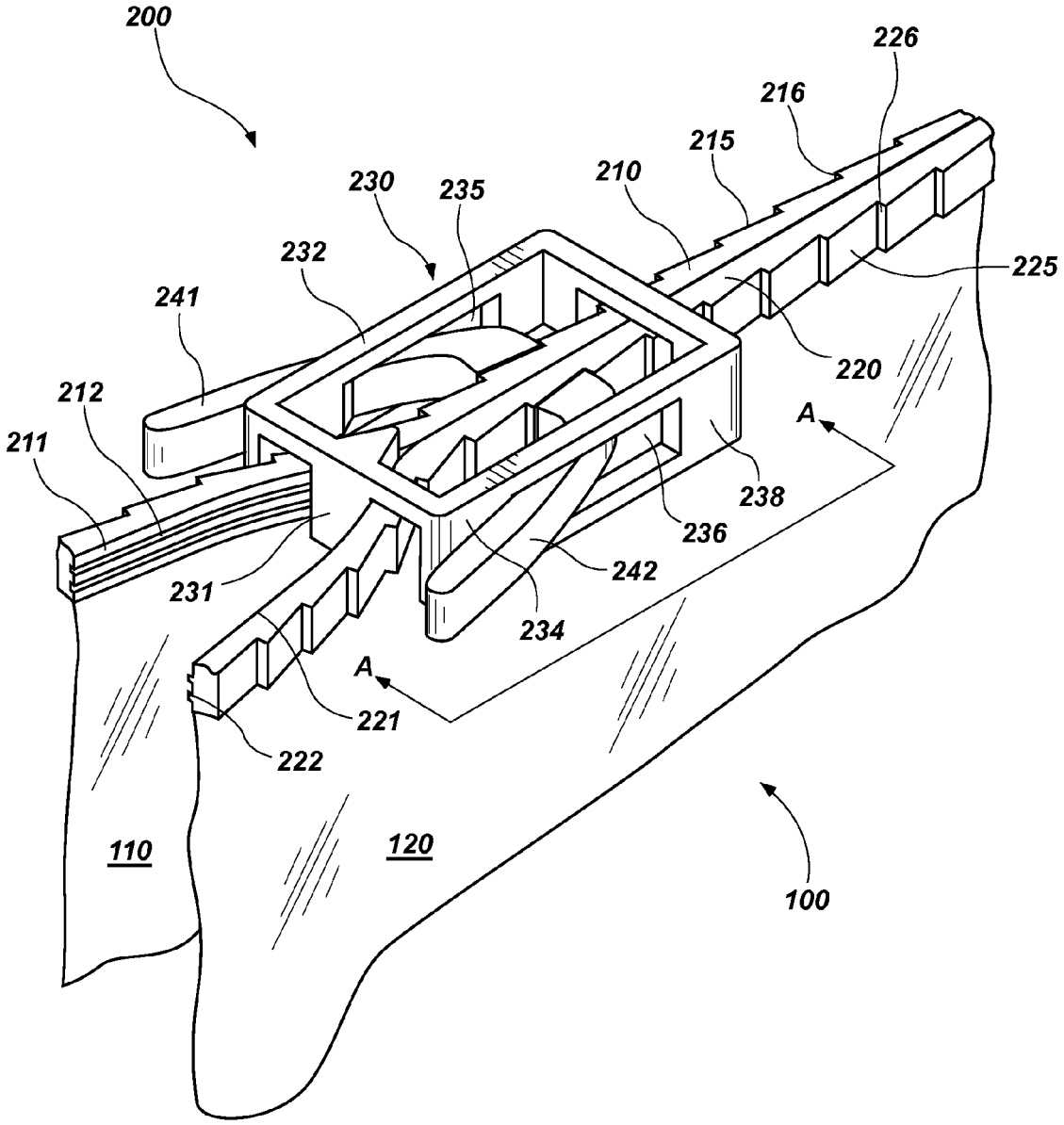
FIG. 1 illustrates one embodiment of a child-resistant reclosable package.

FIG. 1 illustrates one embodiment of a reclosable package 100. Reclosable package 100 comprises a zipper assembly 200 configured to be child-resistant to opening. The zipper assembly 200 comprises first zipper track 210 and second zipper track 220 operably connected to a slider 230 moveable between the first zipper track 210 and the second zipper track 220. The inner surface 211 of the first zipper track 210 comprises first interlocking members 212 formed in and/or on the inner surface 211. The inner surface 221 of the second zipper track 220 comprises second interlocking members 222 formed in and/or on the inner surface 221. The first interlocking member 212 and second interlocking members 222 are configured to interlock with each other. The outer surface 215 of the first zipper track 210 comprises movement resistive elements 216. The outer surface 225 of the second zipper track 220 comprises movement resistive elements 226.

The slider 230 comprises a plow 231 configured to engage between the inner surfaces 211 and 221 of the first and second zipper tracks 210 and 220, respectively. Plow 231 is also configured to separate the first and second interlocking members 212 and 214 from each other when the slider 230 is moved in a forward direction and thereby separate the first and second zipper tracks 210 and 220 from each other. As used herein, "forward" refers to the direction of movement of slider 230 that opens package 100. "Reverse" refers to the direction of movement of slider 230 that closes package 100. Likewise, the "front" of the slider 230 refers to the end of the slider 230 that faces the forward direction and the "back" of the slider 230 refers to the end of the slider 230 that faces the reverse direction.

The slider 230 further comprises a clip arm 241 configured to engage with the movement resistive elements 216 on the outer surface 215 of the first zipper track 210. The slider 230 further comprises a clip arm 242 configured to engage with the movement resistive elements 226 on the outer surface 225 of the second zipper track 220. The clip arms 241 and 242 resist movement of the slider 230 in the forward direction while the clip arms 241 and 241 are engaged with the movement resistive elements 216 and 226, respectively. The clip arm 241 comprises a tab 243 configured to disengage the clip arm 241 from the movement resistive element 216 upon applying sufficient pressure on the tab 243. The clip arm 242 comprises a tab 244 configured to disengage the clip arm 242 from the movement resistive element 226 upon applying sufficient pressure on the tab 244.

In the illustrated embodiment, clip arms 241 and 242 are located on opposing sides of the slider 230 and are oriented generally parallel to the first and second zipper tracks 210 and 220. Or stated another way, clip arms 241 and 242 lie in generally the same plane as first and second zipper tracks 210 and 220 and extend in generally the same longitudinal direction as first and second zipper tracks 210 and 220.

In the illustrated embodiment, tip 247 of clip arm 241 is configured to engage with the movement resistive elements 216 and tip 248 of clip arm 242 is configured to engage with the movement resistive elements 226. In the illustrated embodiment, the movement resistive elements 216 and 226 each comprise a gear rack formed on the outer surfaces 215 and 225, respectively. In the illustrated embodiment, the tips 247 and 248 each comprise hoof-shaped pawls configured to engage with the respective gear rack.

In the illustrated embodiment, the clip arm 241 comprises a leverage point 245 where the clip arm 241 connects with the support wall 233. Likewise, the clip arm 242 comprises a leverage point 246 where the clip arm 242 connects with the support wall 234. In the illustrated embodiment, the leverage point 245 is located approximately halfway along clip arm 241 between the end of tip 247 and the end of the tab 243. Likewise, the leverage point 246 is located approximately halfway along the clip arm 242 between the end of the tip 248 and the end of the tab 244.

The clip arm 241 extends through aperture 235 and clip arm 242 extends through aperture 236. The clip arm 241 is only connected to the remainder of slider 230 at support wall 233. Likewise, clip arm 242 is only connected to the remainder of slider 230 at support wall 234. The height of clip arms 241 and 242 is less than the height of apertures 235 and 236, respectively. Support wall 233 provides resistance to allow leverage point 245 to function as a fulcrum for clip arm 241 when pressure is applied to tab 243. Support wall 234 provides resistance to allow leverage point 246 to function as a fulcrum for clip arm 242 when pressure is applied to tab 244. Support walls 237 and 238 provide support for the front corners of the slider 230. Support walls 233, 234, 237, and 238 form portions of perimeter 232 and provide overall support to slider 230.

First interlocking members 212 are illustrated as grooves configured to mate with the ridges of the second interlocking members 222. It should be understood that first and second interlocking members 212 and 222 may comprise any number of interlocking male and female components in any configuration known in the art. Interlocking members on the inner surfaces of zippers are well-known in the art and, thus, are not disclosed in detail herein.

Plow 231 is illustrated as triangle shaped. Plow 231 may have any shape and dimensions known in the art and compatible with the selected first and second interlocking members 212 and 222. For example, plow 231 may have a post or elongated-spike shape. Plows for separating zipper tracks are well-known in the art and, thus, are not disclosed in detail herein.

Figure 2A:
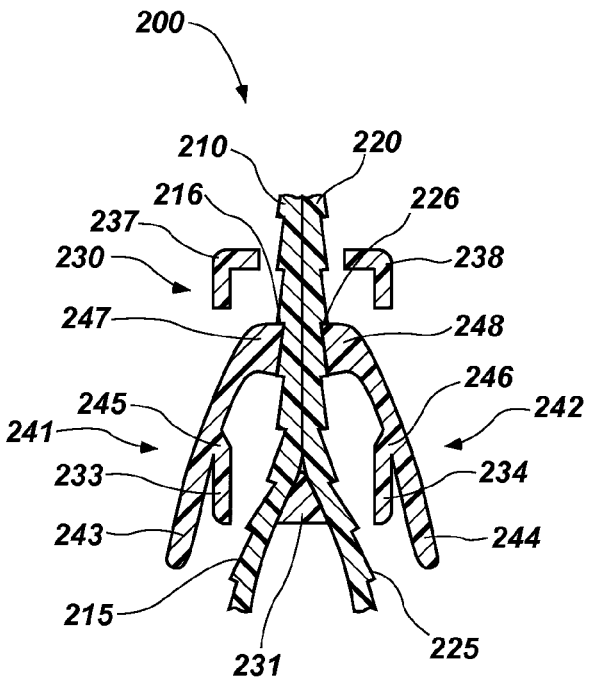
FIG. 2A illustrates a cross-sectional slice of that embodiment along the line A-A.
Figure 2B:
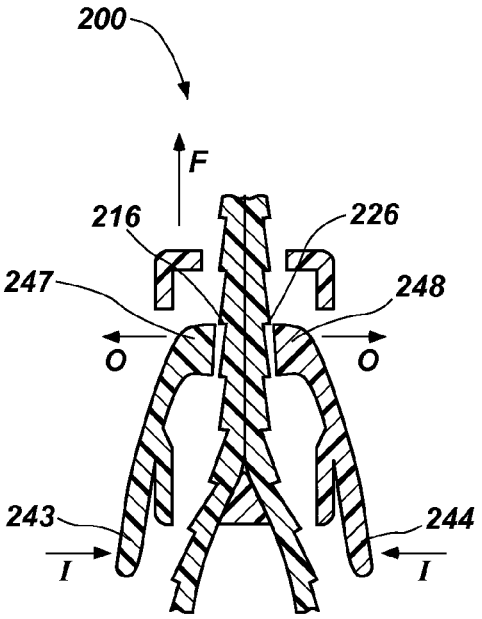
FIG. 2B illustrates the same cross-sectional slice as in FIG. 2A with external force applied to tabs of the clip arms.

FIG. 2A illustrates the position of clip arms 241 and 242 when external force is not applied to tabs 243 and 244, respectively. FIG. 2B illustrates the position of clip arms 241 and 242 when external force is applied to tabs 243 and 244, respectively. Inward movement arrow I illustrates the movement of tabs 243 and 244 as pressure is applied to the outer surfaces of tabs 243 and 244. Outward movement arrow O illustrates the movement of tips 247 and 248 as tabs 243 and 244 are pressed inwardly along the direction of inward movement arrow I. Disengagement of the clip arms 241 and 242 from the movement resistive elements 216 and 226, respectively, allows the slider 230 to move in the direction of forward movement arrow F along the first and second zipper tracks 210 and 220.

In the illustrated embodiment, clip arms 241 and 242 are configured to apply sufficient pressure to the outer surfaces 215 and 225, respectively, so as to interlock the first and second interlocking members 212 and 214 of the first and second zipper tracks 210 and 220. Thus, when pressure is not applied to the tabs 243 and 244 and the slider is moved in a reverse direction (the opposite direction as forward movement arrow F). The material used to make clips arms 241 and 242 and the design of clip arms 241 and 242 may be selected so as to impart the desired characteristics of clip arms 241 and 242.

The clip arms 241 and 242 may be configured to require sufficient pressure on the tabs 243 and 244 to disengage the clip arms 241 and 242 from the movement resistive elements 216 and 226, respectively, so that package 100 qualifies as a "child-resistant package" as defined in ASTM International standard D3475-12. ASTM International standard D3475-12 defines a child-resistant package as "packaging that is designed or constructed to be significantly difficult for children under five years of age to open or obtain a toxic or harmful amount of the substance contained therein within a reasonable time, and not difficult for normal adults to use properly, but does not mean packaging which all such children cannot open or obtain a toxic or harmful amount within a reasonable time."

Additionally and/or alternatively, the clip arms 241 and 242 may comprise a separate spring element configured to apply pressure in the opposite direction as inward movement arrow I on tabs 243 and 244 and thereby provide at least a portion of the pressure needed to sufficiently depress tips 247 and 248 against the outer surfaces 215 and 225, respectively, of the first and second zipper tracks 210 and 220. The separate spring element may also configured to apply some of the resistance to pressure applied to the tabs 243 and 244 in the direction of inward movement arrow I and thereby provide some of the child-resistant features of zipper assembly 200.

In the illustrated embodiment, the slider 230 is integrally molded as a single piece. Likewise, the first and second zipper tracks 210 and 220 may be integrally molded as a single piece. The slider 230 may be designed to compatible with a desired manufacturing process. For example, when the slider 230 is injection molded, then the minimum distance between parts of the slider 230 may be governed by the minimum mold sidewall thickness. For example, the height of aperatures 235 and 236 may be increased relative to the height of clip arms 241 and 242, respectively, so as to facilitate designing a mold that differentiates between the inner surfaces of apertures 235 and 236 and the outer surfaces of clip arms 241 and 242, respectively.

Figure 3A:
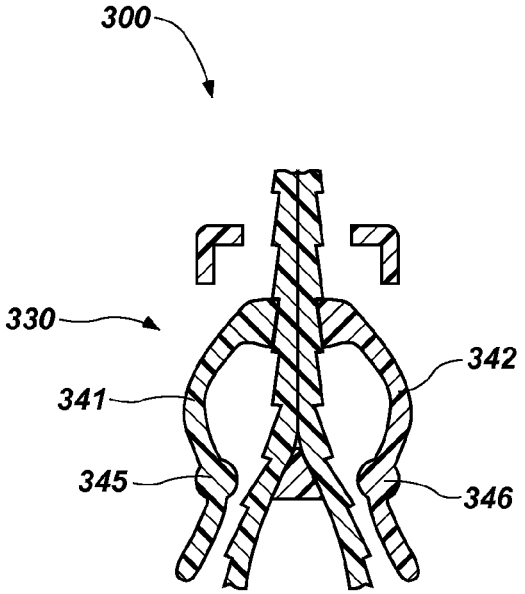
FIG. 3A illustrates one embodiment of a zipper assembly.
Figure 3B:
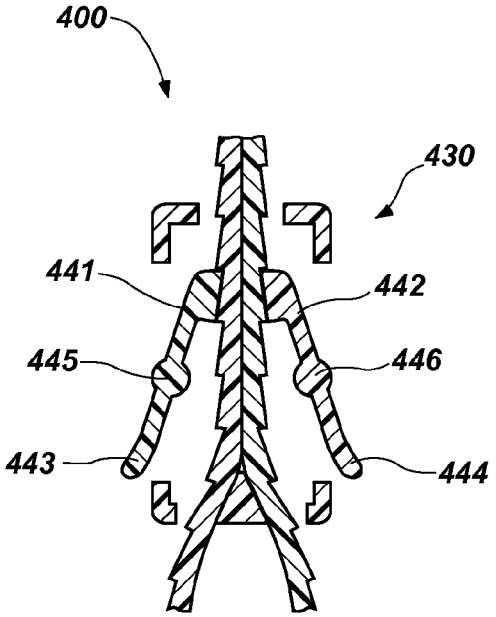
FIG. 3B illustrates another embodiment of a zipper assembly.
Figure 3C:
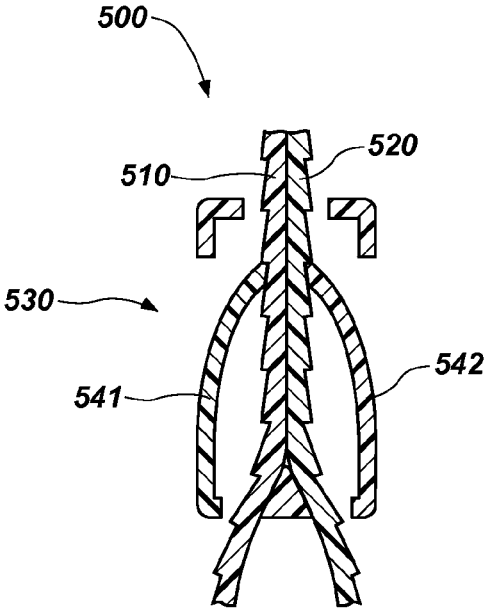
FIG. 3C illustrates yet another embodiment of a zipper assembly.

FIGS. 3A-3C illustrates zipper assemblies analogous to zipper assembly 200. The sliders of FIGS. 3A-3C differ from slider 200 in the location of the leverage points and the shape of the clip arms. It will be appreciated by one of skill in the art having the benefit of this disclosure that analogous components of the sliders may be interchangeable and that disclosure provided in connection with each embodiment may be applicable to the others.

In FIGS. 1, 2A, and 2B, the leverage points 245 and 246 are located about one-third of the way forward from the back end of the slider 230 along the sides of the slider 230. Alternatively, the leverage points 245 and 246 may be located anywhere along the sides or back end of the slider 230.

For example, FIG. 3A illustrates a cross-sectional slice a zipper assembly 300 comprising a slider 330. Slider 330 comprises clip arms 341 and 342. Clip arms 341 and 342 each comprise leverage points 345 and 346, respectively. Leverage points 345 and 346 connect with slider 330 proximal the back end of slider 330.

In another example, FIG. 3B illustrates a cross-sectional slice a zipper assembly 400 comprising a slider 430. Slider 430 comprises clip arms 441 and 442. Clip arms 441 and 442 each comprise leverage points 445 and 446, respectively. Leverage points 445 and 446 connect with slider 430 about half-way along the sides of the slider 430. The clip arms 341 and 342 do not extend beyond the back end of slider 430.

In embodiments where the leverage points do not connect with support walls, such as in FIGS. 3A and 3B, the leverage points may serve as pillars connecting the clip arms with the perimeter structure of the slider. In FIGS. 3A and 3B, the leverage points are pillars with a diameter greater than the width of the clip arms to increase the strength of the leverage points.

FIG. 3C illustrates an embodiment of a slider 530 that does not have clip arm leverage points or tabs. Clip arms 541 and 542 attach to slider 530 proximal the back end of slider 530. In this embodiment, clip arms 541 and 542 may disengage the first and second zipper tracks 510 and 520, respectively, when the back end of slider 530 is squeezed together. Slider 530 may be fabricated from a material that is sufficiently elastic to accomplish the intended purposes of slider 530.

In the embodiment of FIG. 3A, clip arms 341 and 342 each have an S-shape. It should be understood that the clip arms may have any shape compatible with achieving a child-resistant zipper assembly.

Figure 4A:
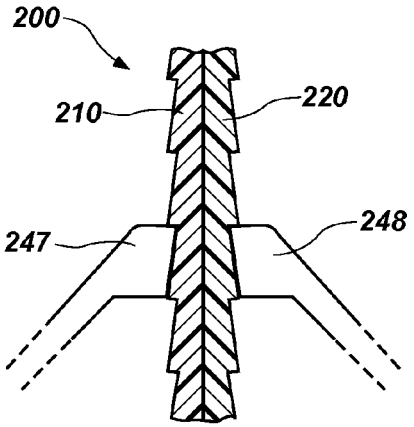
FIG. 4A illustrates engagement of one embodiment of clip arm tips with one embodiment of movement resistive elements.

FIG. 4A illustrates engagement of the hoof-shaped pawls of tips 247 and 248 engaged with the gear racks of movement resistive elements 216 and 226 of zipper assembly 200. Tips 247 and 248 may be configured to engage a single resistive element 216 and 226, respectively. In the case of zipper assembly 200, the single resistive element 216 is a single gear tooth and likewise for the single resistive element 226.

Figure 4B:
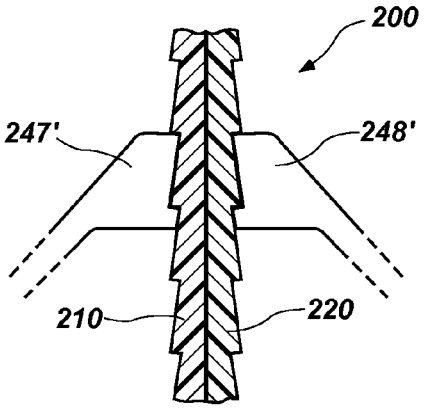
FIG. 4B illustrates engagement of another embodiment of clip arm tips with same embodiment of movement resistive elements as in FIG. 4A.

FIG. 4B illustrates an alternative embodiment where tips 247' and 248' are configured to engage more than one movement resistive element 216 and 226, respectively. In the illustrated embodiment, tips 247' and 248' engage at least part of a second movement resistive element 216 and 226, respectively.

Figure 4C:
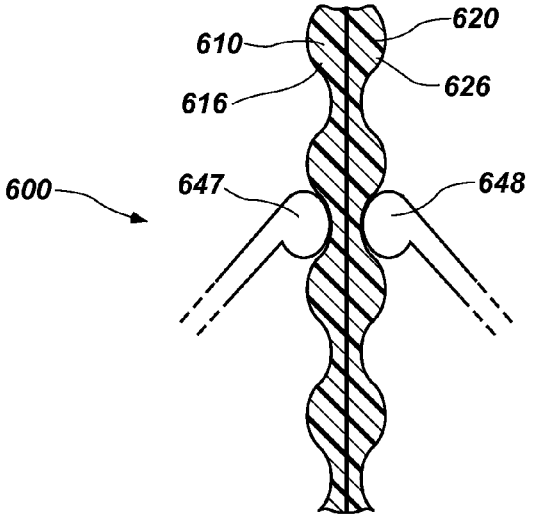
FIG. 4C illustrates engagement of another embodiment of clip arm tips with another embodiment of movement resistive elements.

It should be understood that tips 247 and 248 may have any configuration compatible with movement resistive elements 216 and 226. Additionally, movement resistive elements 216 and 226 may have any structure compatible with resisting forward movement of slider 230. For example, FIG. 4C illustrates a zipper assembly 600 with first and second zipper tracks 610 and 620 where movement resistive elements 616 and 626, respectively, comprise sinusoidal waves. In that embodiment, tips 647 and 648 have oval-shaped pawls configured to mate with the troughs of the sinusoidal waves of movement resistive elements 616 and 626, respectively.

Figure 5A:
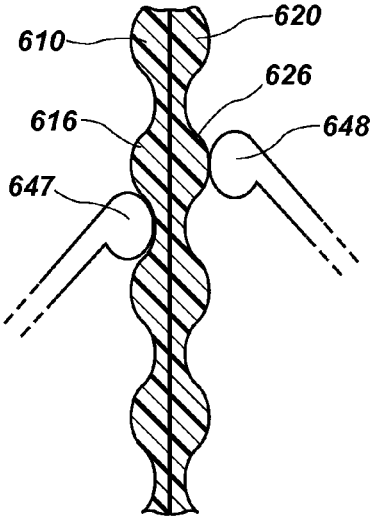
FIG. 5A illustrates offset engagement of the clip arm tips and movement resistive elements of FIG. 4C.
Figure 5B:
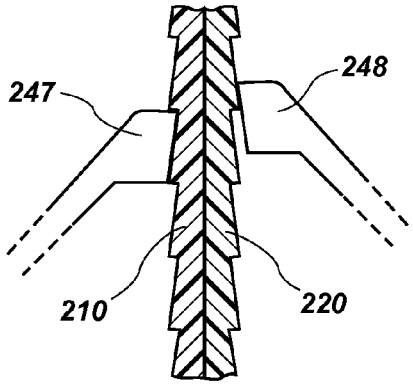
FIG. 5B illustrates offset engagement of the clip arm tips and movement resistive elements of FIG. 4A.

FIG. 4A illustrates tips 247 and 248 as opposing each at the same location on either side of the first and second zipper tracks 210 and 220, respectively. It should be understood that tips 247 and 248 may interact with the first and second zipper tracks 210 and 220 at different respective opposing locations. For example, FIG. 5A illustrates the zipper assembly 600 of FIG. 4C, but with tip 647 offset from tip 648 by a half cycle of the sinusoidal wave. Tip 647 may be configured to engage the trough between two movement resistive elements 616 while tip 648 is configured to be at the top of a movement resistive element 626. FIG. 5B illustrates another example where tips 247 and 248 of zipper assembly 200 are only slightly offset from each other.

The sliders disclosed herein may be comprised of polyethylene or polypropylene. However, the sliders may be fabricated from any material compatible with the intended functions, structure, and/or manufacturing process of the slider. Likewise, the first and second zipper tracks disclosed herein may be comprised of polyethylene or polypropylene. However, the first and second zipper tracks may be fabricated from any material compatible with the intended functions, structure, and/or manufacturing process of the first and second zipper tracks.

Returning to FIG. 1, the reclosable package 100 in addition to zipper assembly 200 comprises first package side 110 operably connected to the first zipper track 110. Reclosable package 100 further comprises second package side 120 operably connected to the second zipper track 120. In some embodiments, the first and second zipper tracks 210 and 220 are located along a top edge of the first and second package sides 110 and 120. In some embodiments, the first and second zipper tracks do not extend along the entire length of the top edge of the first and second package sides 110 and 120. Instead, a portion of each top edge is configured to secure in place the slider 230 when the first and second zipper tracks 210 and 220 are completely closed.

It should be understood that the first and second package sides 110 and 120 may comprise any material compatible with a reclosable package, particularly a reclosable package that is intended to be child-resistant. For example, the first and second package sides 110 and 120 may comprise polymers, such as polyethylene, and woven or non-woven fabrics.

Any methods disclosed herein that comprise one or more steps or actions for performing the described method, then the method steps and/or actions may be interchanged with one another. In other words, unless a specific order of steps or actions is required for proper operation of the embodiment, the order and/or use of specific steps and/or actions may be modified.

References to approximations are made throughout this specification, such as by use of one or more of the terms "about," "approximately," "substantially," and "generally." For each such reference, it is to be understood that, in some embodiments, the value, feature, or characteristic may be specified without approximation. For example, where such a qualifier is used, the terms includes within its scope the qualified word in the absence of the qualifier.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment. Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any embodiment require every feature shown in a particular drawing.

Unless otherwise noted, the terms "a" or "an" are to be construed as meaning "at least one of." In addition, for ease of use, the words "including" and "having" are interchangeable with and have the same meaning as the word "comprising." Recitation of the term "first" with respect to a feature or element does not necessarily imply the existence of a second or additional such feature or element.

The invention claimed is:

1. A zipper assembly configured to be child-resistant to opening, the zipper assembly comprising:

first and second zipper tracks operably connected to a slider moveable between the first and second zipper tracks, wherein the inner surfaces of the first and second zipper tracks comprise interlocking members formed in and/or on the surfaces thereof and configured to interlock with each other, and wherein the outer surfaces of the first and second zipper tracks comprise movement resistive elements;

wherein the slider comprises a plow configured to engage between the inner surfaces of the first and second zipper tracks and configured to separate the interlocking members from each other when the slider is moved in a forward direction and thereby separate the first and second zipper tracks from each other; and wherein the slider further comprises a pair of clip arms configured to engage with the movement resistive elements on the outer surface of the first and second zipper tracks and resist movement of the slider in the forward direction while the clip arms are engaged with the movement resistive elements, wherein the clip arms comprise tabs configured to disengage the clip arms from the movement resistive elements upon applying sufficient pressure on the tabs, wherein disengagement of the clip arms from the movement resistive elements allows forward direction movement of the slider along the first and second zipper tracks.

2. The zipper assembly of claim 1, wherein the clip arms are configured to apply sufficient pressure to the outer surfaces of the first and second zipper tracks so as to interlock the interlocking members on the inner surfaces of the first and second zipper tracks when the slider is moved in a reverse direction and pressure is not applied to the tabs.

3. The zipper assembly of claim 2, wherein the clip arms comprise a separate spring element configured to apply at least a portion of the pressure on the outer surfaces of the first and second zipper tracks and wherein the separate spring element is also configured to apply resistance to pressure applied to the tabs.

4. The zipper assembly of claim 1, wherein the clip arms are configured to require sufficient pressure on the tabs to disengage the clip arms from the movement resistive elements, so that a package utilizing the zipper assembly qualifies as a "child-resistant package" as defined in ASTM International standard D3475-12.

5. The zipper assembly of claim 1, wherein the clip arms are located on opposing sides of the slider.

6. The zipper assembly of claim 5, wherein tips of each of the clip arms are configured to engage with the movement resistive elements.

7. The zipper assembly of claim 6, wherein the clip arms comprise leverage points where the clip arms connect with the rest of the slider, wherein the leverage points are located between the tips of the clip arms and the tabs of the clip arms.

8. The zipper assembly of claim 7, wherein the clip arms are oriented generally parallel to the first and second zipper tracks.

9. The zipper assembly of claim 7, wherein the leverage points are located along the sides of the slider.

10. The zipper assembly of claim 7, wherein the leverage points are located proximal the back end of the slider.

11. The zipper assembly of claim 6, wherein the movement resistive elements comprise a gear rack formed on the outer surfaces of the first and second zipper tracks and the tips of the clip arms comprise pawls configured to engage with the gear rack.

12. The zipper assembly of claim 1, wherein the slider is integrally molded.

13. The zipper assembly of claim 1, wherein the first and second zipper tracks are integrally molded.

14. The zipper assembly of claim 1, wherein the slider comprises polyethylene or polypropylene.

15. The zipper assembly of claim 1, wherein the first and second zipper comprise polyethylene or polypropylene.

16. A reclosable package configured to be child-resistant to opening, the package comprising:

a zipper assembly comprising:

first and second zipper tracks operably connected to a slider moveable between the first and second zipper tracks, wherein the inner surfaces of the first and second zipper tracks comprise interlocking members formed in and/or on the surfaces thereof and configured to interlock with each other, and wherein the outer surfaces of the first and second zipper tracks comprise movement resistive elements;

wherein the slider comprises a plow configured to engage between the inner surfaces of the first and second zipper tracks and configured to separate the interlocking members from each other when the slider is moved in a forward direction and thereby separate the first and second zipper tracks from each other; and wherein the slider further comprises a pair of clip arms configured to engage with the movement resistive elements on the outer surface of the first and second zipper tracks and resist movement of the slider in the forward direction while the clip arms are engaged with the movement resistive elements, wherein the clip arms comprise tabs configured to disengage the clip arms from the movement resistive elements upon applying sufficient pressure on the tabs, wherein disengagement of the clip arms from the movement resistive elements allows forward direction movement of the slider along the first and second zipper tracks; and first and second package sides operably connected to the first and second zipper tracks.

17. The reclosable package of claim 16, wherein the clip arms are configured to apply sufficient pressure to the outer surfaces of the first and second zipper tracks so as to interlock the interlocking members on the inner surfaces of the first and second zipper tracks when the slider is moved in a reverse direction and pressure is not applied to the tabs.

18. The reclosable package of claim 16, wherein the clip arms are configured to require sufficient pressure on the tabs to disengage the clip arms from the movement resistive elements, so that the reclosable package qualifies as a "child-resistant package" as defined in ASTM International standard D3475-12.

19. The reclosable package of claim 16, wherein the first and second zipper tracks are located along a top edge of the first and second package sides.

* * * * *